United States Patent [19]

Schimko et al.

[11] Patent Number: 4,463,577

[45] Date of Patent: Aug. 7, 1984

[54] FLAT KNITTING MACHINE HAVING A PRESSER FOOT DEVICE

[75] Inventors: Reinhold Schimko, Aalen-Wasseralfingen; Josef Köninger, Westhausen, both of Fed. Rep. of Germany

[73] Assignee: Universal Maschinenfabrik Dr. Rudolf Schieber GmbH & Co., Westhausen, Fed. Rep. of Germany

[21] Appl. No.: 344,842

[22] Filed: Feb. 1, 1982

[30] Foreign Application Priority Data

Feb. 9, 1981 [DE] Fed. Rep. of Germany ..... 3104533

[51] Int. Cl.[3] ..... D04B 7/04

[52] U.S. Cl. ..... 66/64

[58] Field of Search ..... 66/60 H, 64 R, 60

[56] References Cited

U.S. PATENT DOCUMENTS

| | | | |
|---|---|---|---|
| 3,049,900 | 8/1962 | Bram | 66/60 |
| 3,153,922 | 10/1964 | Bram | 66/64 |
| 3,685,317 | 8/1972 | Giachetti et al. | 66/64 |
| 3,842,623 | 10/1974 | Flavell et al. | 66/64 |
| 4,080,806 | 3/1978 | O'Sullivan et al. | 66/64 |
| 4,081,973 | 4/1978 | Theys | 66/64 |

*Primary Examiner*—Ronald Feldbaum

*Attorney, Agent, or Firm*—Sughrue, Mion, Zinn, Macpeak and Seas

[57] ABSTRACT

A flat knitting machine with a carriage movable over the needle beds has presser foot wires with free trailing ends arranged in holders to extend in the direction of travel of the carriage in front of the withdrawal positions of the needles. For simple construction and selective utilization of the presser foot device the holders for the presser foot wires are secured on a slider which slides along the needle beds on a thread guide rail, and the slider is selectively entrained by the carriage by means of entraining pins carried displaceably on the carriage. The holders for the stroking-in wires are preferably displaceable vertically towards the needle bed combs.

6 Claims, 2 Drawing Figures

FLAT KNITTING MACHINE HAVING A PRESSER FOOT DEVICE

BACKGROUND OF THE INVENTION

This invention relates to a flat knitting machine comprising a carriage movable over the needle beds and presser foot wires with free trailing ends mounted in holders so as to extend in the direction of travel of the carriage in front of the withdrawal positions of the needles.

If thread combinations are to be produced on flat knitting machines, where the take-up device, for example in the form of take-up rollers, exerts insufficient influence, then presser foot wires are used which hold the stitches down as the needles are being withdrawn. The withdrawal of the needles takes place during knitting i.e. during the formation of stitches or loops, and upon transfer of the stitches.

In known flat knitting machines which have a pressure foot device the holders for the presser foot wires are mounted on the carriage and are so arranged that they are always located in the direction of travel of the carriage in front of the withdrawal position of the needles. The presser foot wire lies between the needle bed combs and below the needles which cross upon withdrawal. The trailing wire ends must in each case be free. This means therefore that each presser foot wire can only be set into place for operation in one direction of travel of the carriage. In known flat knitting machines, pivotable holders arranged on the carriage have therefore been used for example, which each have a presser foot wire extending to the left and to the right and which, depending upon the direction of travel of the carriage, are pivoted to the left or to the right into the position beneath the crossing needles. In another known pressure foot device, for each direction of travel of the carriage, there is provided one presser foot wire which by means of its pivotable mounting on the carriage can be pivoted automatically into or out of a functional position.

In another known presser foot device a presser foot wire overhangs its holder which is fastened to the carriage and at the positions of reversal of movement of the carriage is displaced across by the holder in such a manner that it overhangs on the appropriate side and such that it is brought into the presser foot position with a free trailing wire end. All the known presser foot devices are secured to the carriage so that they must always be in operation.

SUMMARY OF THE INVENTION

It is an object of the present invention to provide a flat knitting machine of the type first referred to above which has a presser foot device which is simple in construction, which can be selectively brought into operation by the carriage as desired, and which only moves jointly with the carriage if its function is necessary.

This object is achieved in accordance with the present invention in that the holders for the presser foot wires are secured on a slider which slides along the needle beds on one of the thread guide rails, and in that the slider can be entrained selectively by the carriage by entraining means, such as pins, displaceably mounted on the carriage.

The presser foot device of the machine of the present invention, controlled by the machine controls, is entrained by the carriage as the occasion demands, or is disconnected outside the working width of the flat knitting machine in the zone of carriage reversal.

Preferably, the holders for the presser foot wires are displaceable vertically towards the needle bed combs, so that, depending upon the direction of carriage travel, the presser foot wire or wires provided for the next carriage traverse can be brought into their operative positions.

Certain selected pieces of knitting, for example parts of pullovers, consist of a border and a patterned body part. The presser foot device is only required for the patterned body part, and needs to be suppressed during the knitting of the border. In the flat knitting machine of the present invention the presser foot device is disconnected as the occasion demands outside the working width within the carriage reversal zone and can be called back into action as necessary. Such a selective entrainment of the presser foot device can also be significant during the knitting of a body part, since for this the presser foot device is required several times or not at all. Since the holders for the presser foot wires in known presser foot devices are secured to the carriage, in those cases a selective introduction of the presser foot device is not possible.

Preferably, lifting cams for raising the entraining pins are provided on the frame of the machine in the regions where the carriage reverses its direction of movement. Also, it is advantageous if one entraining pin is provided for each direction of travel of the carriage.

The entraining pins preferably comprise an entraining or pick-up finger which during the traverse, opens a resilient inclined flap which constitutes part of the lifting cam on the machine frame, so that the traverse of the particular entraining pin which has been switched into operation is not hindered.

Furthermore, indexing cams for vertical displacement of the holders for the presser foot wires are preferably provided in the region of the lifting cams, again on the machine frame, in order to displace the wires into and out of their operative positions. By means of these indexing cams on the left-hand and right-hand sides of the machine the particular presser foot wires which are in operation can be taken out of operation and the presser foot wires for the next carriage traverse can be brought into operation.

In a preferred embodiment of the invention three vertically displaceable holders equipped with presser foot wires are provided for each direction of travel of the carriage.

BRIEF DESCRIPTION OF THE DRAWINGS

In order that the invention may be fully understood, a preferred embodiment of device in accordance with the invention will now be described by way of example and with reference to the accompanying drawing. In the drawing.

DESCRIPTION OF THE PREFERRED EMBODIMENT

Figure 1:
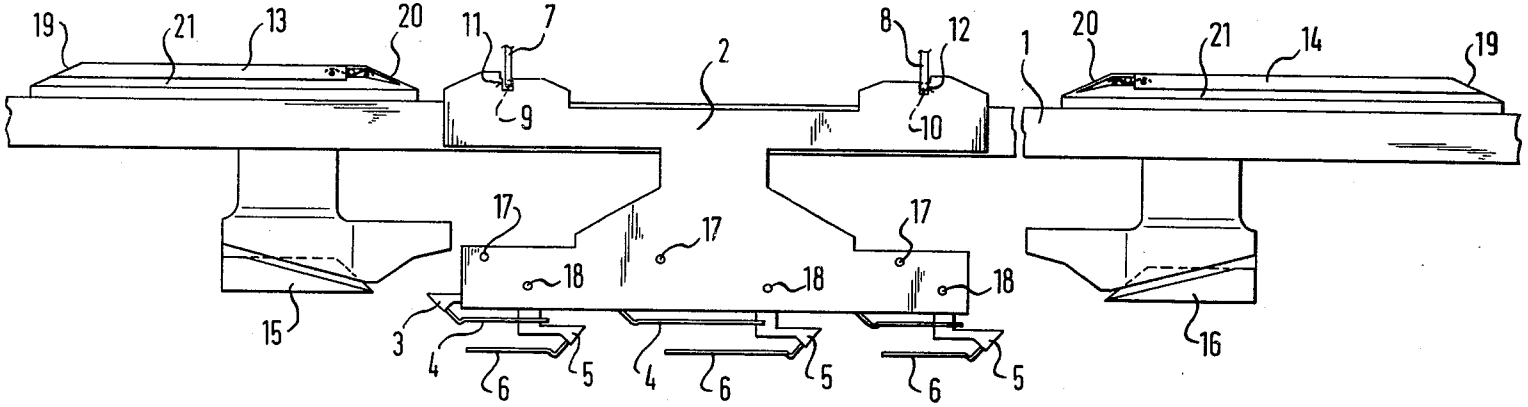
FIG. 1 is a side view of the preferred embodiment of presser foot device in accordance with the invention, together with the associated lifting cams and indexing cams on the machine frame; and, FIG. 2 is a cross-sectional view through one of the entraining pins as positioned in the region of one of the lifting cams.

The presser foot device of a flat knitting machine shown in the drawing comprises a slider 2 which slides on a thread guide rail 1 extending parallel to the longitudinal axis of the needle beds. Holders 3 for presser foot wires 4 for a working from right to left, as well as holders 5 for presser foot wires 6 for a working from left to right, are mounted on the slider 2 for displaceable back and forth movement vertically towards the needle bed combs (not shown). In the operative position shown in the drawing the presser foot wires 6 for the working from left to right are located in their operative positions, while the presser foot wires 4 are shifted out of their operative positions.

On the carriage (not shown) of the flat knitting machine there are provided displaceable entraining pins 7 and 8 which have entraining fingers 9 and 10 which lie within corresponding recesses 11 and 12 in the slider 2.

At the two regions where the carriage undergoes a reversal of movement there are provided left and right lifting cams 13 and 14 on the frame of the machine. These lifting cams 13 and 14 ensure that there is a satisfactory alternation in the entrainment of the slider 2 of the presser foot device.

Additionally, left and right indexing cams 15 and 16 are provided arranged on the frame of the machine at the two regions where the carriage undergoes a reversal of movement. By means of entraining fingers 17 and 18 arranged on the respective holders 3 and 5 these indexing cams 15 and 16 cause the vertical shifting of the holders 3 and 5 together with their presser foot wires 4 and 6 respectively.

The two entraining pins 7 and 8, which are displaceably mounted on the carriage (not shown), are intended selectively to entrain or pick up the slider 2, and thus selectively entrain the presser foot device to move it in the two directions of travel of the carriage. If, for example, the carriage moves to the right, then the left-hand entraining pin 7 is engaged. It displaces the slider 2 to the right. The right-hand entraining pin 8 also lies within its recess 12, but it is at this time not carrying out any function. When the presser foot device reaches the region of the right-hand lifting cam 14, then the right-hand entraining pin 8 is lifted up. It runs along over the surface of the right-hand lifting cam 14 and slides down again into its recess 12 when it reaches the right-hand flank 19 of the right-hand lifting cam 14.

At this stage the left-hand entraining pin 7 becomes uncoupled as it travels up a resilient sloping flap 20 at the left-hand side of the right-hand lifting cam 14. The right-hand entraining pin 8 then takes over the task of the left-hand entraining pin 7, guides the presser foot device along through the right-hand carriage reversal, and drives the presser foot device back to the left. The left-hand entraining pin 7 lies within its recess 11 but has no function in this part of the cycle.

Consequently, the right-hand entraining pin 8 is not uncoupled as the carriage moves to the left, and its entraining finger 10 slides in a groove 21 formed in the right-hand lifting cam 14. The resilient flap 20 at the left-hand side of the right-hand lifting cam 14 opens as the entraining finger 10 traverses the groove 21, so that the entraining pin 8 can carry out the traverse to the left without hindrance. At the left-hand position of reversal of the carriage a corresponding sequence of events takes place.

The indexing cams 15 and 16 which are mounted on the left-hand and right-hand sides of the machine have the function of switching over the presser foot wires at the positions of carriage reversal, for example switching over the operative presser foot wires 6 to an inoperative position and switching over the presently inoperative presser foot wires 4 to an operative position, and vice versa.

Figure 2:
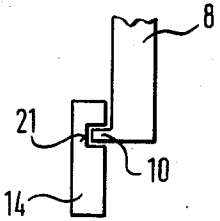

FIG. 2 shows the entraining finger 10 of the right-hand entraining pin 8 extending into the groove 21 of the right-hand lifting cam 14.

We claim:

1. A flat knitting machine comprising thread guide rail means adapted to extend along the axis of the needle beds, separate slider means mounted for reciprocating sliding movement on said guide rail means, entraining means adapted to be carried by the carriage of the knitting machine for selective shifting into and out of engagement with said separate slider means for entraining said separate slider means for movement with said carriage in opposite directions, presser foot wires having free trailing end portions adapted to extend in the direction of travel of the carriage in front of the withdrawal position of the needle, holder means supporting said presser foot wires mounted on said separate slider means for vertical sliding movement towards the needle bed combs.

2. A flat knitting machine as set forth in claim 1 further comprising lifting cam means mounted on said knitting machine at the point where said carriage reverses its traversing movement for lifting said entraining means.

3. A flat knitting machine as set forth in claim 1 wherein a respective entraining means is provided for each direction of travel of the carriage.

4. A flat knitting machine as set forth in claim 1 wherein said lifting cam means are each provided with a resilient inclined flap and wherein said entraining means is comprised of a pin having a finger which is adapted to open said resilient inclined flap in the traversing movement of said entraining means.

5. A flat knitting machine as set forth in claim 2 further comprising indexing cam means mounted on said knitting machine in the region of said lifting cam means for imparting vertical movement to said holders for moving the pressure foot wires into and out of their operative positions.

6. A flat knitting machine asset forth in claim 1 wherein said three vertically moveable holders for carrying presser foot wires are provided for each direction of travel of the carriage.

* * * * *